US006685598B1

(12) United States Patent
Rufino

(10) Patent No.: US 6,685,598 B1
(45) Date of Patent: Feb. 3, 2004

(54) EPICYCLE GEAR EXERCISE DEVICE

(75) Inventor: John Rufino, Whittier, CA (US)

(73) Assignee: Unisen, Inc., Irvine, CA (US)

( * ) Notice: Subject to any disclaimer, the term of this patent is extended or adjusted under 35 U.S.C. 154(b) by 0 days.

(21) Appl. No.: 09/456,743

(22) Filed: Dec. 7, 1999

Related U.S. Application Data

(60) Provisional application No. 60/111,476, filed on Dec. 9, 1998.

(51) Int. Cl.[7] ..... A63B 71/00

(52) U.S. Cl. ..... 482/51; 482/57; 482/60; 482/63

(58) Field of Search ..... 482/51–53, 57–65

(56) References Cited

U.S. PATENT DOCUMENTS

| | | | | |
|---|---|---|---|---|
| 3,316,898 A | | 5/1967 | Brown | |
| 4,168,495 A | | 9/1979 | Sweeney | |
| 4,312,033 A | | 1/1982 | Sweeney et al. | |
| 4,353,019 A | | 10/1982 | Sweeney, Jr. | |
| 4,509,742 A | | 4/1985 | Cones | |
| 4,786,068 A | | 11/1988 | Tang | |
| 5,562,574 A | | 10/1996 | Miller | |
| 5,690,589 A | | 11/1997 | Rodgers, Jr. | |
| 5,707,321 A | | 1/1998 | Maresh | |
| 5,833,583 A | * | 11/1998 | Chuang | 482/60 |
| 6,027,430 A | * | 2/2000 | Stearns et al. | 482/51 |

* cited by examiner

*Primary Examiner*—Nicholas D. Lucchesi
*Assistant Examiner*—Tam Nguyen
(74) *Attorney, Agent, or Firm*—Knobbe, Martens, Olson & Bear, LLP

(57) ABSTRACT

An improved elliptical path exercise machine is provided that is simple and robust in its construction, requires minimal maintenance, provides smooth even exercise motion, and which has a compact foot-print. The apparatus includes a pair of planetary gears, sun/ring gears and at least one crank. The crank is supported and arranged so as to be rotatable about a crank axis. Each planetary gear is pivotably secured to the crank about a pivot point located and arranged such that as the crank is rotated the planetary gears engage and rotate relative to their corresponding sun/ring gears while simultaneously revolving about the crank axis so as to form right and left epicylic gear trains. Two foot pedals are each pivotably secured to a corresponding one of the planetary gears and are sized and arranged to support the feet of a user. The layout and geometries of the device are such that each foot-pedal follows a substantially elliptical foot-path as the crank is rotated. The major axis of the elliptical foot-path is greater than twice the effective crank-arm length of the crank so that a compact foot print is attained.

63 Claims, 6 Drawing Sheets

EPICYCLE GEAR EXERCISE DEVICE

RELATED APPLICATIONS

This application claims the benefit under 35 U.S.C. §119 (e) of U.S. Provisional Patent Application No. 60/111,476, filed on Dec. 9, 1998.

BACKGROUND OF THE INVENTION

1. Field of the Invention

The present invention relates to an exercise apparatus for providing simulated walking or running motion and, in particular, a simple, compact exercise apparatus for producing a generally elliptical foot path motion using a combination of epicyclic, planetary and/or sun/ring gears.

2. Description of the Related Art

The benefits of regular exercise to improve overall health, fitness and longevity are well documented in the literature. Medical science has consistently demonstrated the improved strength, health, and enjoyment of life which results from physical activity. Aerobic exercises, such as jogging and walking, are particularly popular and medically recommended exercises for conditioning training and improving overall health and cardiovascular efficiency.

However, modern lifestyles often fail to accommodate accessible running or walking areas. In addition, inclimate weather and other environmental and social factors may cause individuals to remain indoors as opposed to engaging in outdoor physical activities.

There are also certain dangers and/or health risks associated with walking, jogging or running on natural outdoor surfaces. For example, medical experience has demonstrated that knee and ankle joints are often strained or injured when joggers run on paved or uneven surfaces or jogging paths which change direction often. Other examples of common injuries resulting from jogging, particularly on uneven terrain, may include foot sores, pulled or strained muscles, strained tendons and cartilage, back injuries, and head injuries, not to mention the risk of physical harm from pedestrian crossing accidents or even criminal activity. Thus, many exercise enthusiasts prefer the safety and convenience of an in-home or commercial exercise machine in order to provide desired exercise without the attendant inconvenience and risk of outdoor exercise.

Presently available indoor exercise devices for commercial or home use come in a wide variety of sizes and configurations. Typical indoor exercise devices may include, for example, stationary bicycles for simulating bicycle pedaling action, simulated stepping machines for simulating or replicating the motion associated with stair stepping exercise, and treadmills for simulating running, jogging, or walking. Other popular exercise devices include ski simulators and a wide variety of weight lifting or resistance training exercise equipment.

Each of these exercise machines has particular advantages and disadvantages for accomplishing a desired fitness goal. For example, treadmills generally permit a user to walk, jog or run on a stationary platform or endless belt. As such, treadmills are particularly well suited for general fitness and endurance training. However, the foot impact associated with walking or running may be undesirable in some cases due to advanced age, pregnancy, or other health conditions. In those cases it may be beneficial for the user to engage in a more low impact or non-impact exercise.

Cycling simulators, ski simulators, and stair simulators are particularly noted for the elimination of impacts affecting the hips, knees, ankles, and feet of a user. However, such exercise machines have a limited range of motion such that certain muscle groups are often not fully exercised to the degree desired by the user. In particular, these machines do not faithfully reproduce what many consider to be the most natural and beneficial exercise motions—namely, walking and running.

More recently, elliptical foot path exercise devices have been introduced into the market and have become popular for both home and commercial use. These devices provide a broader range of foot motion generally tracing a path approximating an ellipse or modified ellipse. For example, U.S. Pat. No. 5,299,993 to Steams shows a modified stair stepping exercise machine which incorporates both vertical and horizontal movement using a combination of linkages to guide the foot pedals in an elliptical or ovate path. Habing in U.S. Pat. Nos. 5,299,993 and 5,499,956 provides articulated linkages controlled through cables by motor to move the foot pedals through an ovate path. Both devices guide the foot pedals using linkages and rollers operating against a linear guide track.

Like Stearns and Habing, most conventional elliptical exercise devices employ a variety of moving parts, such as linkages, pivots, slide tracks and other components to attain a desired elliptical foot path. These moving components are not only expensive to manufacture and assemble, but are subject to increased wear and incidence of malfunction or breakage. Thus, significant upkeep and repair is required to maintain these devices in good working order. Also, it is unavoidable that the various moving components must have a certain mass and, thus, the dynamics and changing velocities and accelerations of the individual linkages and other moving components can often impart to the exercise machine an undesirable uneven stride motion or "kick". This can make the device more difficult to use and decrease the smoothness and non-impact gliding ability of the exercise machine. Excessive acceleration of particularly massive linkages can cause undesired torsional or bending strain within associated support and pivot members, increasing wear and the risk of potential catastrophic failure.

Another drawback of many conventional elliptical path exercise machines is the relatively large amount of space occupied by the machine's "foot-print." The footprint is the amount of floor area an exercise machine occupies when properly set up, giving due consideration for any additional clearances required for safe operation of the machine and for ingress and egress of users. Smaller foot-print machines are more desirable for commercial use, such as in gyms, health spas and the like, because of the cost of renting and maintaining commercial floor space.

Notably, many of the prior art elliptical exercise devices utilize foot pedals that are rigidly attached to extended foot linkages. These foot linkages, in turn, are provided in connected relationship between a crank at one end and a guide or reaction roller at the other end. Therefore, in a typical multi-bar linkage elliptical exercise machine the longest dimension of the machine's foot print typically extends well beyond the major axis of the elliptical foot path. This is due to the fact that the axis of the crank as it turns a wheel or other device when considered with the axis of the connection at the end of the crank limits the overall stroke distance to the working diameter of the crank or twice the crank arm length, which forms the major axis of the elliptical path. Also, the reaction roller is typically required to be situated well rearward of the foot linkage in order to provide the desired amount of vertical displacement in the elliptical path motion.

For example to achieve a sixteen inch length in the major axis of the elliptical foot-path of a conventional elliptical path trainer, the crank of the trainer needs to have a longer crank arm length than half the length which would be eight inches. This takes into account the journaling and bearing mountings. From a practical standpoint in order to provide a sixteen inch length of the major axis of the elliptical path, a nine inch long crank must be utilized to provide approximately an eighteen inch diameter circle. In addition, the foot linkage may extend another twenty-four to thirty-six inches rearward beyond the point of attachment to the crank to engage a guide roller. Thus, the total displacement of the crank and linkage required to achieve a sixteen inch running stride could be as long as forty to fifty inches or more. This translates into an undesirably large or elongated foot print relative to the length of the stride path achieved.

SUMMARY OF THE INVENTION

Accordingly, it is a principle object and advantage of the present invention to overcome some or all of these limitations by providing an improved elliptical path exercise machine that is simple and robust in its construction, requires minimal maintenance, provides smooth even exercise motion, and which has a compact foot-print.

In accordance with one embodiment the present invention provides an exercise apparatus for providing simulated walking or running motion. The apparatus includes a pair of planetary gears, sun/ring gears and at least one crank. The crank is supported and arranged so as to be rotatable about a crank axis. Each planetary gear is pivotably secured to the crank about a pivot point located and arranged such that as the crank is rotated the planetary gears engage and rotate relative to their corresponding sun/ring gears while simultaneously revolving about the crank axis so as to form right and left epicyclic gear trains. Two foot pedals are each pivotably secured to a corresponding one of the planetary gears and are sized and arranged to support the feet of a user. The layout and geometries of the device are such that each foot-pedal follows a substantially elliptical foot-path as the crank is rotated.

In accordance with another embodiment the present invention provides an exercise apparatus for providing simulated walking or running motion comprising a support frame and at least one crank pivotably supported relative to the support frame so as to be rotatable about a crank axis. At least one planetary gear is pivotably supported relative to the crank and is rotatable therewith. At least one sun/ring gear is also supported relative to the support frame and sized and positioned to engage the planetary gear so as to form an epicyclic gear train. A foot-pedal is pivotably supported relative to the planetary gear for supporting a user's foot. The layout and geometries of the device are such that the foot-pedal follows a substantially elliptical foot-path as the crank is rotated. Optionally, the effective working diameter of the planetary gear is equal to one-half the effective working diameter of the sun/ring gear and twice the effective crank-arm length of the crank so that the foot-path remains stable and does not precess with each successive foot-path cycle. Desirably, the major axis of the elliptical foot-path is greater than twice the effective crank-arm length of the crank so that a compact foot print is attained.

In accordance with another embodiment the present invention provides an exercise apparatus for providing simulated walking or running motion and including a plurality of gears sized, positioned and supported relative to one another so as to form an epicyclic gear train. The plurality of gears includes at least one planetary gear to which a foot-pedal is pivotably secured and supported for receiving and supporting a user's foot. By virtue of the epicyclic motion of the planetary gear to which the foot-pedal is secured, the foot-pedal is caused to trace a substantially elliptical foot-path as the epicyclic gear train operates.

In accordance with another embodiment the present invention provides an elliptical foot-path exercise apparatus including a support frame and at least one crank having an effective crank-arm length and being pivotably supported relative to the support frame so as to be rotatable about a crank axis. A foot pedal is provided in mechanical communication with the crank. The foot pedal is sized and arranged relative to the crank so that it follows a substantially elliptical foot-path relative to the support frame and so that the major axis of the elliptical foot-path is greater than twice the effective crank-arm length.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENTS

Figure 1:
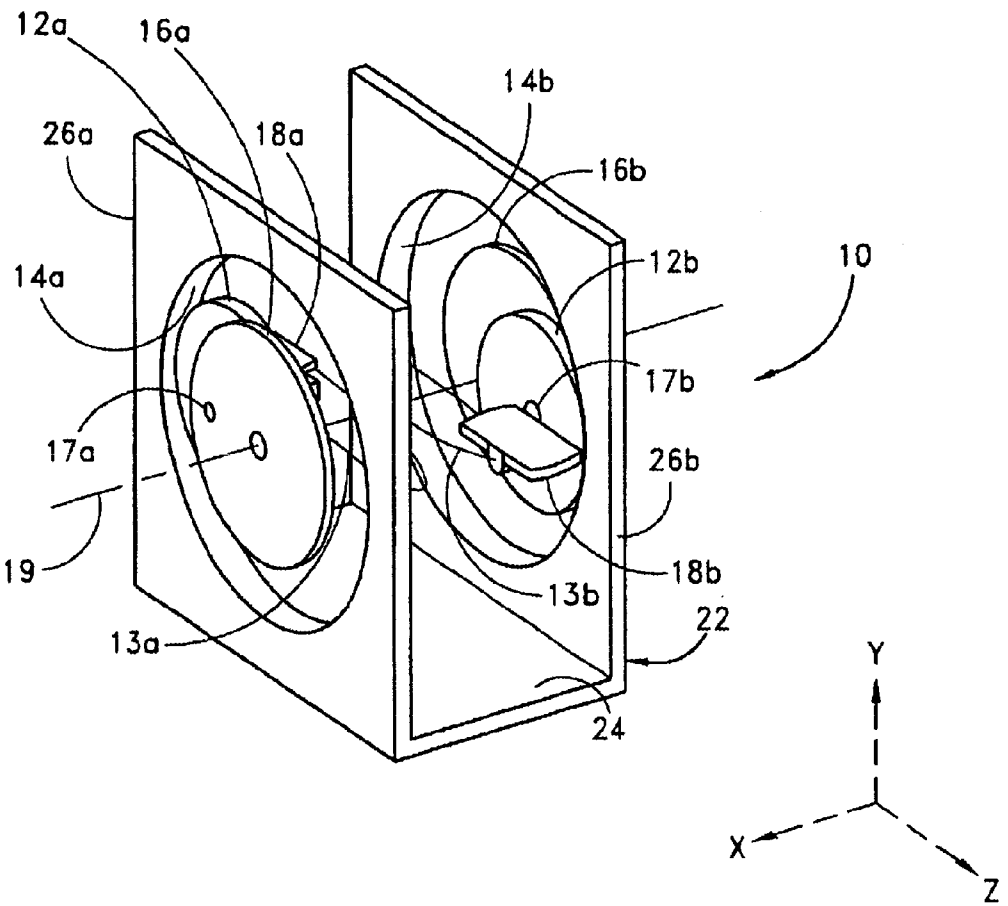
FIG. 1 is a perspective partial schematic view of one embodiment of an epicyclic gear exercise device having features in accordance with the present invention.

FIG. 1 is a perspective schematic view of one embodiment of an epicyclic gear exercise device 10 having features in accordance with the present invention. For purposes of describing certain aspects of the invention as embodied in the epicyclic gear exercise device 10 of FIG. 1 only the left side of the apparatus may be described. However, those skilled in the art will readily recognize that identical or similar structures are or may be incorporated on the right side of the apparatus and that such structures will or are intended to operate in a similar or identical manner. Alternatively, those skilled in the art will also recognize that certain structures described as having identical right and left counterpart structures may be combined into a single structure to simplify the construction of the device and reduce costs.

Fundamentally, the exercise device 10 comprises planetary gears 12*a*, 12*b*, sun/ring gears 14*a*, 14*b* and crank wheels 16*a*, 16*b*. Each planetary gear 12*a*, 12*b* is pivotably secured to each corresponding crank wheel 16*a*, 16*b* about a pivot point 17*a*, 17*b* and is sized and arranged such that as each crank wheel 16*a*, 16*b* is rotated, planetary gears 12*a*, 12*b* engage and rotate relative to the sun/ring gears 14*a*, 14*b* while simultaneously revolving about the crank axis 19. In this manner, each planetary gear 12*a*, 12*b*, its associated sun/ring gear 14*a*, 14*b* and crank 16*a*, 16*b* form an epicylic gear train. Foot pedals 18*a*, 18*b* are pivotably secured preferably to the inside of each corresponding planetary gear 12*a*, 12*b* and are sized and arranged to support the feet of a user while tracing substantially elliptical foot paths 13*a*, 13*b*.

The size and shape of the elliptical paths is determined by a number of controlled parameters, including the relative working diameters of the various gears and cranks involved and the positioning of the foot pedals 18*a*, 18*b* on respective pedals axles 15 relative to the planetary gear pivot axes 17*a*, 17*b*. Positioning the foot pedals 18*a*, 18*b* closer to the planetary gear pivot axes 17*a*, 17*b* creates a wider ellipse while positioning them farther away creates a more narrow ellipse. If desired, suitable adjustment means such as slide tracks or multiple pivot connection points can be provided for adjusting the relative position of each foot pedal 18*a*, 18*b*.

To avoid cyclical precession of the elliptical foot paths 13*a*, 13*b* and to ensure a constant and predictable foot path motion, each planetary gear 12*a*, 12*b* preferably has an effective working diameter that is equal to one-half of the effective working diameter of the associated sun/ring gear 14*a*, 14*b*. Alternatively stated, the number of working teeth in the periphery of each planetary gear 12*a*, 12*b* is preferably equal to one-half the number of working teeth in the periphery of each sun/ring gear 14*a*, 14*b*. This ensures that each planetary gear will make exactly −2 rotations per +1 revolution about the crank axis 19 such that the foot pedals begin and end each footpath cycle in the same position. Alternatively, each sun/ring gear may be counter-rotated or additional gearing may be provided as needed to counteract any such precession effects.

Other than as stated above, the particular size, shape and design of the various gears, cranks and pedals comprising the exercise device 10 are relatively unimportant. Based on the particular geometries of the preferred embodiment shown in FIG. 1, the crank wheels 16*a*, 16*b* preferably have a working diameter of at least about eight inches so as to provide a theoretical maximum sixteen inch length in the major axis of the elliptical foot paths 13*a*, 13*b*. The crank wheels 16*a*, 16*b* preferably have a working radius or effective crank-arm length of at least about four inches measured from the crank axis 19 to the planetary gear axes 17*a*, 17*b*. This dimension is also preferably equal to one-half the diameter of the associated planetary gear 12*a*, 12*b* so as to provide the above-noted anti-precession effect. The sun/ring gears 14*a*, 14*b* preferably have effective working diameters of at least about 16 inches.

The entire gear train structure shown and described above may be supported in a suitable frame, chassis or other support means adapted to secure the illustrated components in the operative relationship shown. This support means may comprise any variety of well known structures giving due consideration to the desired orientation and relationship between the various gears, cranks and pedals as shown. For example, FIG. 1 illustrates a simple U-shaped frame 22 having a base 24 and side walls 26*a*, 26*b*. The frame 22 may be formed from any variety of materials and components well known in the art, such as stainless steel or aluminum plates welded or bolted together. Preferably the frame 22 is sized, shaped and dimensioned so as to accommodate a human user supported on the foot pedals 18*a*, 18*b* of the epicylic gear exercise device 10.

Figure 2:
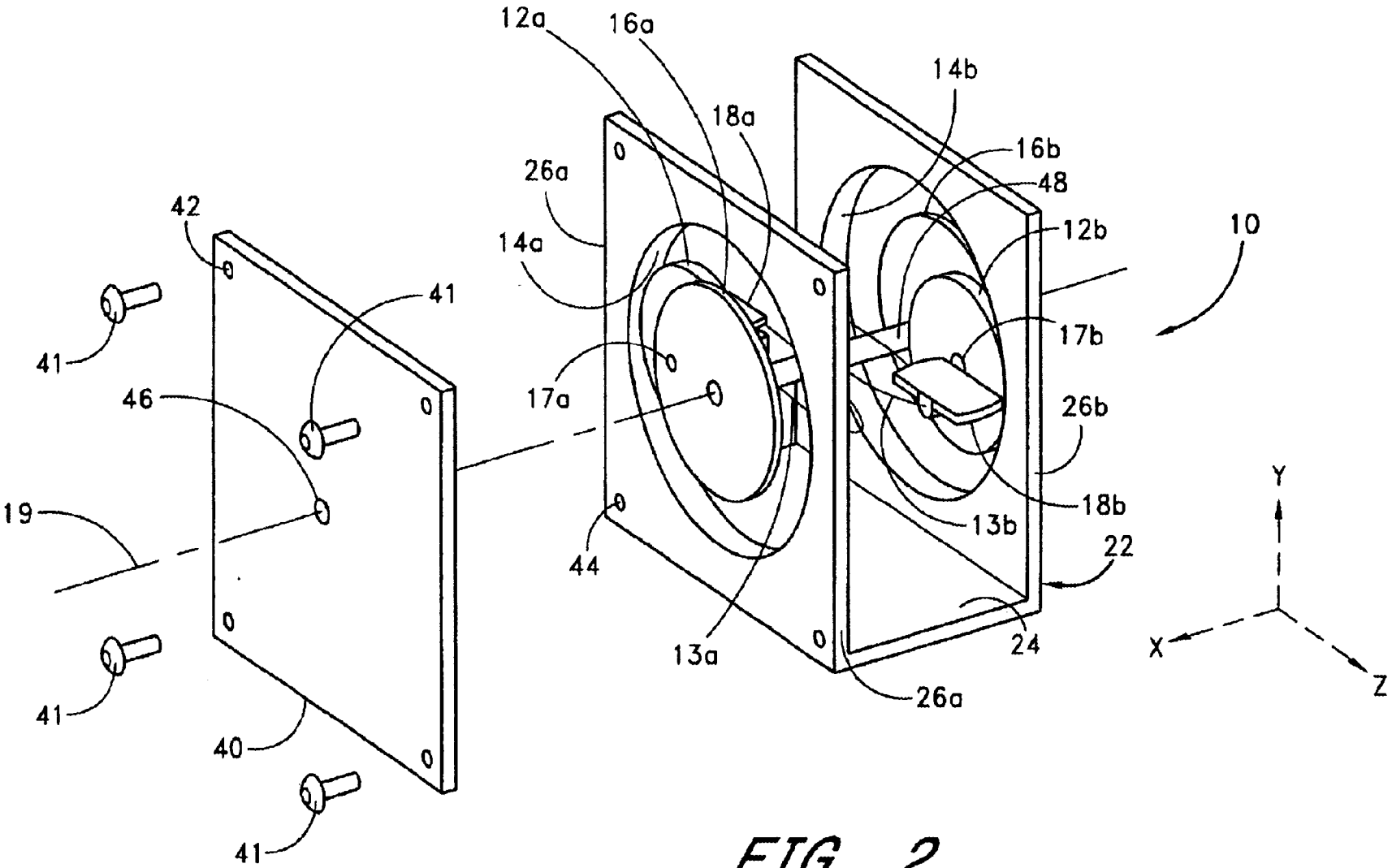
FIG. 2 is an exploded perspective partial schematic view of the epicyclic gear exercise device of FIG. 1 modified to include a crank wheel support plate and a central shaft connecting the right and left gear trains.

The crank wheels 16*a*, 16*b* can be similarly supported by a crank support plate 40, such as illustrated in the exploded view of FIG. 2. In FIG. 2 the support plate 40 is illustrated as being formed of a clear or translucent material such as plexiglass or acrylic. This is for purposes of illustration and/or aesthetic embellishment only. While such structures may be desirable for certain applications, such as demonstration equipment, it is not necessary to practice the invention. The plate 40 may alternately be formed of suitable grade stainless steel, aluminum or any variety of other well-known structural materials as desired, giving due consideration to the goal of securely supporting the crank wheel 16*a* as shown.

The plate 40 may be secured to the frame 22 via bolts 41 threaded through thru-holes 42 formed in plate 40 and threaded holes 44 formed in the side wall 26*a* of frame 22. A central aperture 46 is formed in the plate 40 and is sized and arranged to receive a support shaft, such as shaft 48, to pivotably support crank wheel 16*a*. The aperture 46 is preferably fitted with a bearing or insert into which the shaft 48 is journaled. While only one plate 40 is shown, those skilled in the art will readily recognize that another plate may be secured to the opposite side in a similar fashion to support crank wheel 16*b*. If desired, auxiliary support structures (not shown) may optionally be provided to support or assist the user in using the exercise device 10 and/or to provide means for simultaneous arm/hand exercise.

Figure 3:
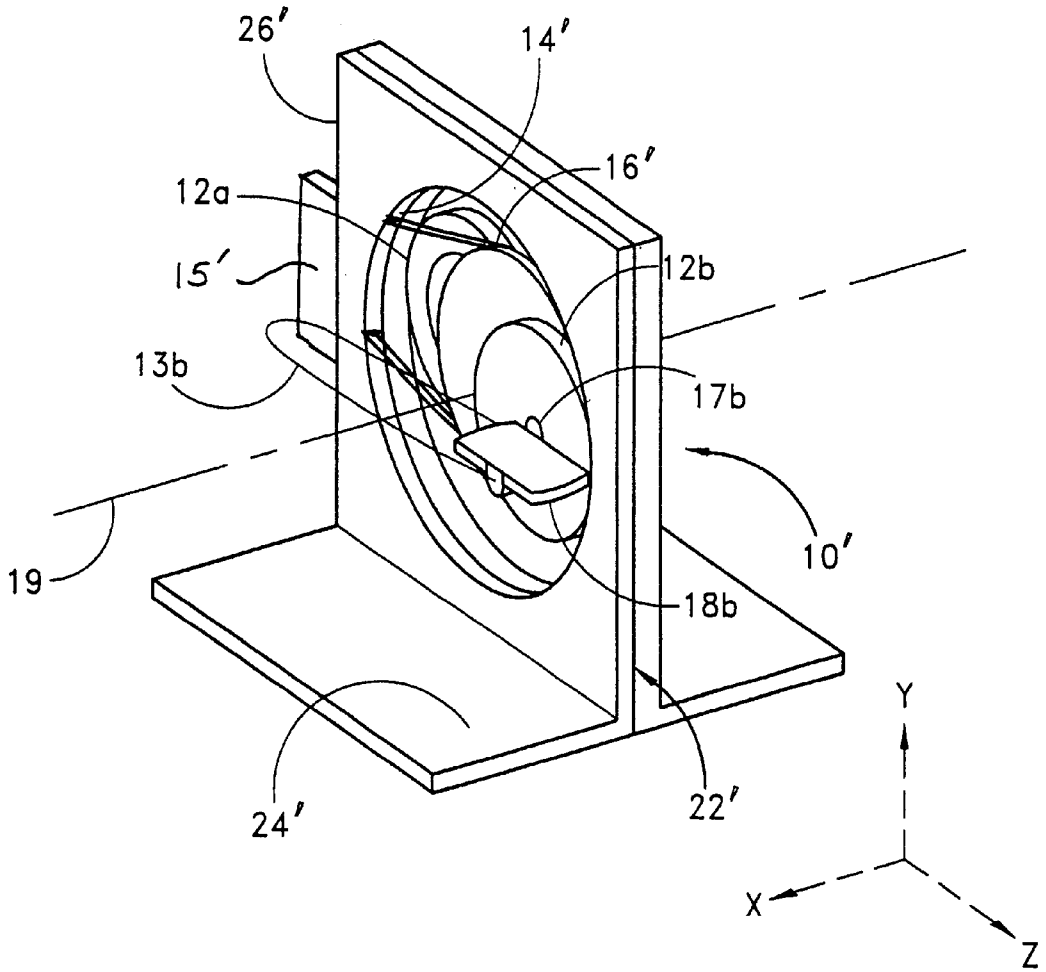
FIG. 3 illustrates a second modified embodiment of an epicyclic gear exercise device having features of the present invention.

Alternatively, those skilled in the art will readily recognize that a wide variety of other support structures and various other design configurations may be used while still enjoying the benefits and advantages of the invention as taught herein. For example, if desired the orientation of the right and left gear trains relative to one another may be reversed or inverted such that crank wheels 16*a*, 16*b* face each other and/or are combined into a single structure and such that foot pedals 18*a*, 18*b* are pivotably secured to the outside of each corresponding planetary gear 12*a*, 12*b*. FIG. 3 illustrates one such inverted embodiment of an epicyclic gear exercise device 10' having features of the present invention. For purposes of illustration and ease of understanding, like structures are denoted with like reference numerals. In the embodiment illustrated in FIG. 3, a single central crank wheel 16' and sun/ring gear 14' are used to provide right and left epicyclic gear trains. In this case, the foot pedals 18*a*, 18*b* are pivotably secured to the outer faces of the planetary gears 12*a*, 12*b* such that the user's feet would straddle the exercise device 10' when in use.

In each of the embodiments discussed above, the right and left gear trains are preferably coupled to a resistance device and/or a motor 15'. This may be a common or shared resistance device and/or motor or they may be separate with each gear train having its own resistance device and/or motor. Any one of a variety of well known resistance devices and/or motors may be used, such as friction belts, fans, electric motors/generators and the like. Most preferably an electronically controlled motor/generator is used to provide variable mode operation between active (user driven) and passive (motor driven) exercise modes. Such a system is disclosed and described, for example, in U.S. Pat. No. 5,195,935 incorporated herein by reference.

If a shared resistance device and/or motor is used then a shaft 48 may be aptly sized and configured to connect the left side gear train to the right side gear train, as shown in the modified embodiment of FIG. 2, so that the foot pedals 18*a*, 18*b* are preferably maintained 180° apart. If necessary, the overall physical diameter of the planetary gears 12*a*, 12*b* may be reduced slightly while maintaining the desired gear ratio in order to provide adequate clearance for shaft 48. This may be accomplished by making slight adjustments to the gear pitch or tooth spacings. A suitable drive gear or pulley (not shown) may then be provided on the shaft 48 to couple both gear trains to a common resistance device.

Alternatively, the two gear trains may be maintained entirely or partially independent from one another. In that case other synchronizing means, such as internal or external gearing or regulators, may be used to coordinate or synchronize the foot pedals as desired. For example, electronic control circuitry associated with each resistance device or motor may alternately be used to vary the drive or load on each gear train to attain a desired synchronization between the right and left gear trains. Such synchronization may either be constant or variable throughout the stride path, as desired, to provide the most effective and beneficial stride motion.

Figure 4:
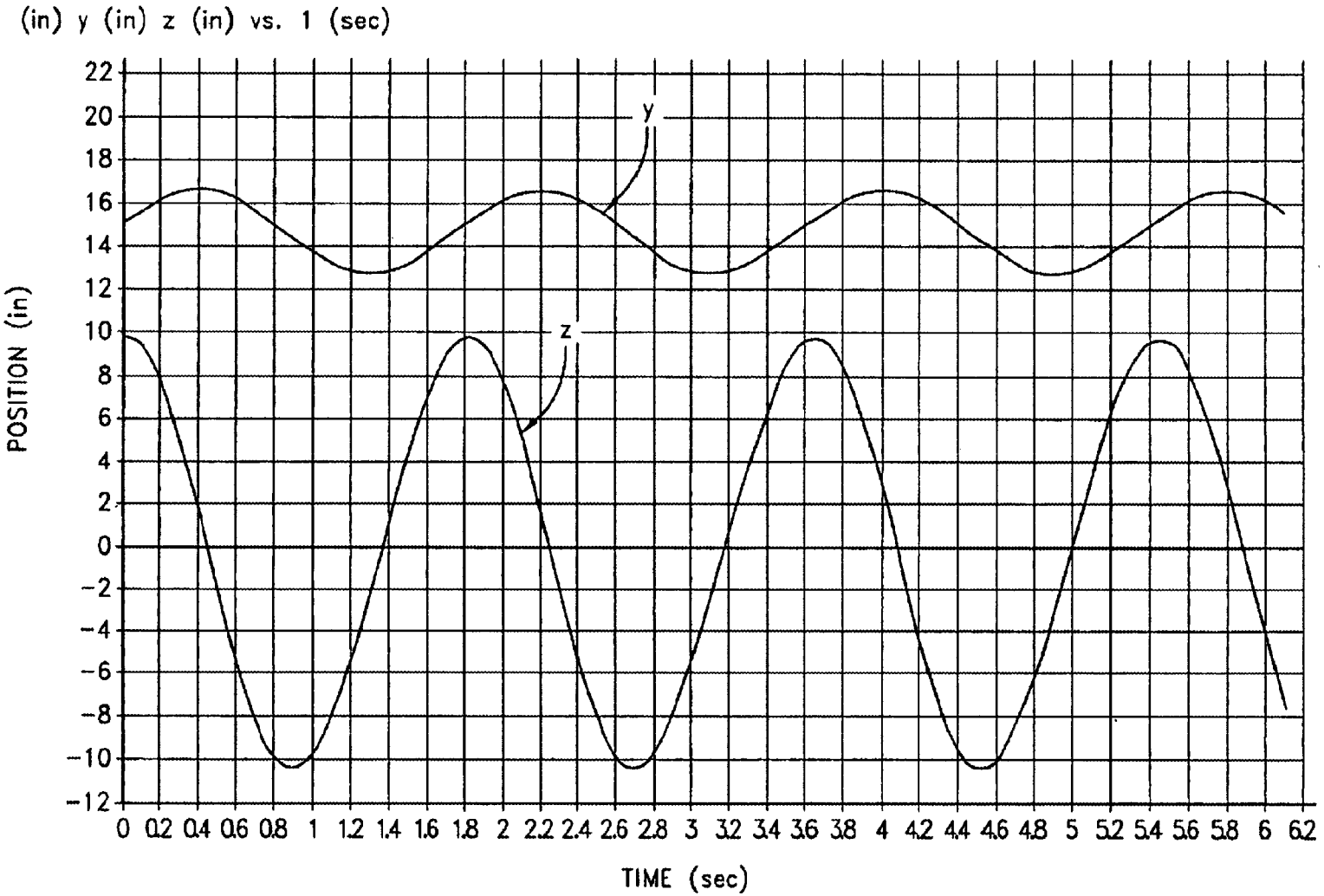
FIG. 4 is a graph of foot path displacement of the epicyclic gear exercise device of FIG. 1 along the Y and Z axes.

FIG. 4 is a graph of foot-pedal displacement of the epicyclic gear exercise device of FIG. 1 in both the Y and Z directions. As shown, the foot-pedal displacement "z" in the Z direction (stride length) follows a substantially smooth sinusoidal path from +10 inches at the beginning of each cycle at t=0, 1.80, 3.60 and 5.40 seconds, to −10 inches at the end of each first half-cycle at t=0.85, 2.65 and 4.45 seconds. The foot-pedal displacement "y" in the Y direction (stride height) similarly follows a substantially smooth sinusoidal path from +16.5 inches at the beginning of each cycle at t=0, 1.80, 3.60 and 5.40 seconds, to +12.5 inches at the end of each first half-cycle at t=0.85, 2.65 and 4.45 seconds.

Figure 5:
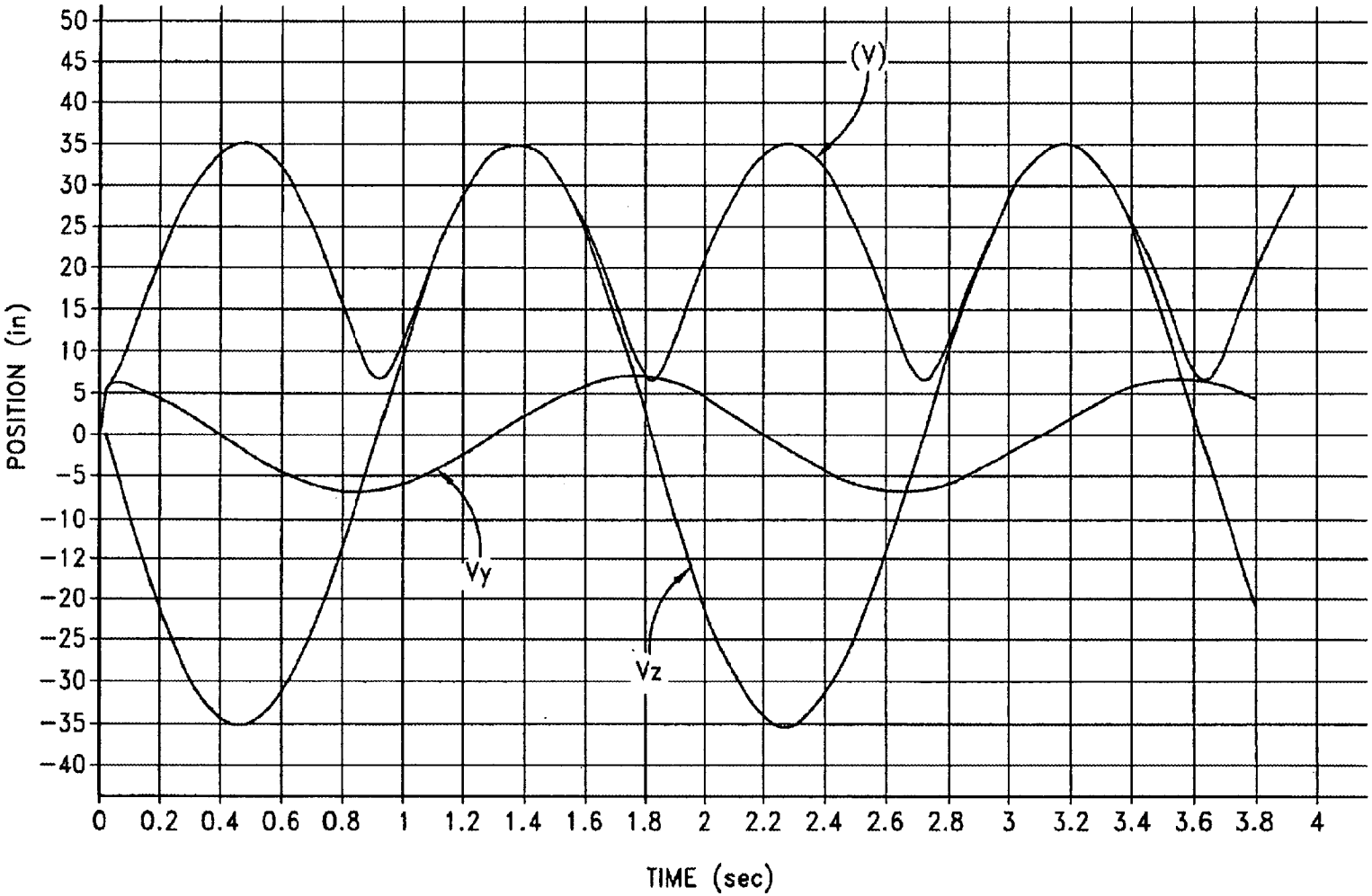
FIG. 5 is a graph of foot path velocity of the epicyclic gear exercise device of FIG. 1 along the Y and Z axes.

FIG. 5 is a graph of foot-pedal velocity of the epicyclic gear exercise device of FIG. 1 in both the Y and Z directions. As shown, the foot-pedal velocity $V_z$ in the Z direction (stride length) follows a substantially smooth sinusoidal path from 0 in./sec. at the beginning of each cycle at t=0 and 1.80 seconds, to −35 in./sec. at the end of each first quarter-cycle at t=0.45 and 2.35 seconds, through 0.0 in./sec again at the end of each second quarter-cycle at t=0.85 and 2.75, to +35 in./sec. at the end of each third quarter-cycle at t=1.35 and 3.15 seconds. The foot-pedal velocity $V_y$ in the Y direction (stride height) similarly follows a substantially smooth sinusoidal path from 7 in./sec. at the beginning of each cycle at t=0 and 1.80 seconds, through 0 in./sec. at the end of each first quarter-cycle at t=0.45 and 2.35 seconds, to −7 in./sec again at the end of each second quarter-cycle at t=0.85 and 2.75, to 0 in./sec. at the end of each third quarter-cycle at t=1.35 and 3.15 seconds. The absolute velocity |V| also follows a substantially smooth and continuous roughly sinusoidal path, as illustrated in FIG. 5, with the exception of a small transient response from t=0 to 0.05 seconds associated with initial start-up.

Figure 6:
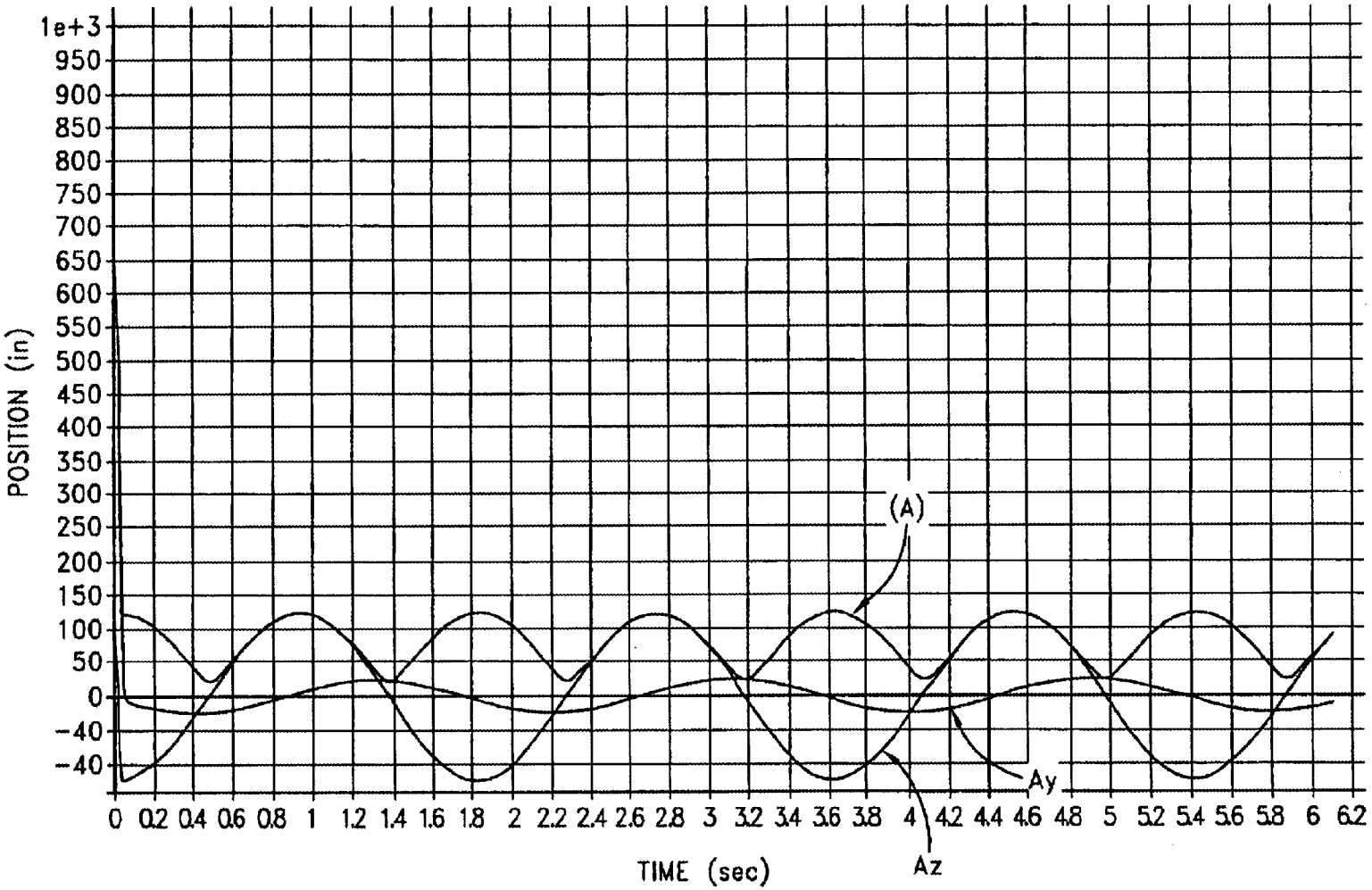
FIG. 6 is a graph of foot path acceleration of the epicyclic gear exercise device of FIG. 1 along the Y and Z axes.

FIG. 6 is a graph of foot-pedal acceleration of the epicyclic gear exercise device of FIG. 1 in both the Y and Z directions. As shown in FIG. 6, and with the exception of the transient response from t=0 to 0.05 the foot-pedal acceleration $A_z$ in the Z direction (stride length) follows a substantially smooth sinusoidal path from −125 in./sec$^2$ at the beginning of each cycle at t=0, 1.80, 3.6 and 5.4 seconds, through 0 in./sec$^2$ at the end of each first quarter-cycle at t=0.45, 2.35 and 4.1 seconds, to +125 in./sec$^2$ at the end of each second quarter-cycle at t=0.85, 2.75 and 4.45, and back through 0 in./sec$^2$ at the end of each third quarter-cycle at t=1.35, 3.15 and 4.95 seconds. The foot-pedal acceleration $A_y$ in the Y direction (stride height) similarly follows a substantially smooth sinusoidal path from 0 in./sec$^2$ at the beginning of each cycle at t=0, 1.80, 3.6 and 5.4 seconds, to −25 in./sec$^2$ at the end of each first quarter-cycle at t=0.45, 2.35 and 4.1 seconds, through 0 in./sec$^2$ again at the end of each second quarter-cycle at t=0.85, 2.75 and 4.45, and to +25 in./sec$^2$ at the end of each third quarter-cycle at t=1.35, 3.15 and 4.95 seconds. The absolute acceleration |A| also follows a substantially smooth and continuous roughly sinusoidal path, as illustrated in FIG. 6, again with the exception of the initial transient.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An exercise apparatus comprising a support frame, at least one crank being supported relative to said support frame, said at least one crank being rotatable about a crank axis, at least one planetary gear having an effective working diameter and being connected to said at least one crank, said at least one planetary gear being rotatable about a planetary axis and comprising an effective working diameter, at least one sun/ring gear being connected to said support frame and being sized and positioned to engage said at least one planetary gear, said sun/ring gear having an effective working diameter, at least one foot-pedal being connected to said at least one planetary gear such that said at least one foot-pedal is not capable of substantial translation relative to said planetary gear, and said at least one foot-pedal following a substantially elliptical foot-path having a major axis and a minor axis when said at least one crank rotates.

2. The exercise apparatus of claim 1, wherein said effective working diameter of said at least one planetary gear is equal to one-half said effective working diameter of said at least one sun/ring gear.

3. The exercise apparatus of claim 1 wherein said effective working diameter of said at least one planetary gear is equal to about twice said effective crank-arm length of said at least one crank.

4. The exercise apparatus of claim 1, wherein said at least one crank has an effective crank-arm length and wherein said major axis of said elliptical foot-path is greater than twice said effective crank-arm length.

5. The exercise apparatus of claim 4, wherein said major axis of said elliptical foot-path is about quadruple said effective crank-arm length.

6. The exercise apparatus of claim 1 comprising two planetary gears pivotably supported relative to said at least one crank and rotatable therewith and two foot-pedals one attached to each of said planetary gears.

7. The exercise apparatus of claim 1 further comprising a resistance device or motor coupled to said at least one crank.

8. An exercise apparatus comprising a plurality of gears sized, positioned and supported relative to one another so as to form an epicyclic gear train, said plurality of gears comprising at least one planetary gear, at least one foot-pedal being supported by said at least one planetary gear for rotation with said at least one planetary gear about a generally circular path around a rotational axis of said at least one planetary gear, said at least one foot-pedal also tracing a substantially elliptical foot-path having a major axis and a minor axis as said epicyclic gear train operates.

9. The exercise apparatus of claim 8 further comprising at least one sun/ring gear sized and supported so as to engage said at least one planetary gear and wherein said at least one planetary gear has an effective working diameter equal to one-half an effective working diameter of said at least one sun/ring gear.

10. The exercise apparatus of claim 8 further comprising a rotatable crank having an effective crank-arm length and said effective working diameter of said at least one planetary gear being equal to about twice said effective crank-arm length.

11. The exercise apparatus of claim 10, wherein said major axis of said elliptical foot-path is greater than twice said effective crank-arm length.

12. The exercise apparatus of claim 11, wherein said major axis of said elliptical foot-path is about quadruple said effective crank-arm length.

13. The exercise apparatus of claim 12 comprising two planetary gears pivotably supported relative to said at least one crank and being rotatable therewith and a foot-pedal respectively supported by each of said planetary gears.

14. The exercise apparatus of claim 8 further comprising a resistance device or motor coupled to said at least one crank.

15. An elliptical foot-path exercise apparatus comprising:

a support frame;

at least one crank being supported relative to said support frame so as to be rotatable about a crank axis, said at least one crank having an effective crank-arm length;

at least one foot pedal being connected to said at least one crank through at least one intermediate member such that said at least one foot pedal is attached to said at least one intermediate member and said at least one intermediate member is attached to said at least one crank, by an intermediate axle said at least one intermediate member revolving relative to said crank about said intermediate axle and said foot pedal revolving relative to said intermediate member about a foot pedal axis, said at least one foot pedal being sized and arranged relative to said at least one crank so as to follow a substantially elliptical foot-path comprising a major axis, a length of said major axis of said elliptical foot-path being adjustable by varying a point-of-attachment of said at least one foot pedal along said at least one intermediate member.

16. The exercise apparatus of claim 15, wherein said major axis of said elliptical foot-path is about quadruple said effective crank-arm length.

17. The exercise apparatus of claim 15 comprising at least one planetary gear mechanically coupling said at least one crank to said at least one foot pedal and being sized and arranged to engage at least one sun/ring gear so as to form an epicyclic gear train, wherein each of said gears has an effective working diameter and said at least one planetary gear is said at least one intermediate member.

18. The exercise apparatus of claim 17, wherein said effective working diameter of said at least one planetary gear is equal to one-half said effective working diameter of said at least one sun/ring gear.

19. The exercise apparatus of claim 15 further comprising a resistance device and/or motor coupled to said at least one crank.

20. An exercise apparatus for providing simulated walking or running motion comprising two planetary gears, two sun/ring gears and at least one crank supported and arranged so as to be rotatable about a crank axis, said two planetary gears each comprising an effective diameter and said two sun/ring gears also each comprising an effective diameter, each said planetary gear being pivotably secured to a pivot point on said at least one crank and each said planetary gear being sized and arranged such that as said at least one crank is rotated said planetary gears engage and rotate relative to said sun/ring gears while simultaneously revolving about said crank axis so as to form an epicyclic gear train, and two foot pedals each pivotably secured to a pivot point on a corresponding one of said planetary gears, said foot pedals being sized and arranged to support the feet of a user and whereby each said foot-pedal follows a substantially elliptical foot-path as said at least one crank is rotated.

21. The exercise apparatus of claim 20, wherein said effective working diameter of each of said planetary gears is equal to one-half said effective working diameter of each said sun/ring gear.

22. The exercise apparatus of claim 20, wherein said at least one crank has an effective crank-arm length, and said effective working diameter of each of said planetary gears is equal to about twice the effective crank-arm length of said at least one crank.

23. The exercise apparatus of claim 20, wherein said elliptical foot path has a major axis and a minor axis, and wherein said major axis of said elliptical foot-path is greater than twice said effective crank-arm length of said at least one crank.

24. The exercise apparatus of claim 23 wherein said major axis of said elliptical foot-path is about quadruple said effective crank-arm length.

25. The exercise apparatus of claim 20 further comprising a resistance device and/or motor coupled to said at least one crank.

26. An exercise apparatus for providing simulated walking or running motion comprising a support frame, at least one crank pivotably supported relative to said support frame so as to be rotatable about a crank axis, at least one planetary gear pivotably supported relative to said at least one crank and rotatable therewith, at least one sun/ring gear supported relative to said support frame and sized and positioned to engage said at least one planetary gear so as to form an epicyclic gear train, at least one foot-pedal being adapted to support a user's foot and said at least one foot-pedal being pivotably supported relative to said at least one planetary gear such that the user's foot will revolve in a circular pattern around a rotational axis of said at least one planetary gear, whereby said at least one foot-pedal follows a substantially elliptical foot-path as said at least one crank rotates, said elliptical path having a major axis and a minor axis, and said at least one crank having an effective crank-arm length.

27. The exercise apparatus of claim 26 wherein the major axis of said elliptical foot-path is about quadruple said effective crank-arm length.

28. An exercise apparatus for providing simulated walking or running motion comprising a plurality of gears sized, positioned and supported relative to one another so as to form an epicyclic gear train, said plurality of gears including at least one planetary gear, a rotatable crank having an effective crank-arm length for rotating said at least one planetary gear, the effective working diameter of said at least one planetary gear being equal to about twice said effective crank-arm length, at least one foot-pedal having a foot support portion adapted to support a user's foot, said at least one foot-pedal being pivotably supported relative to said at least one planetary gear for supporting a user's foot at a pedal axis, said pedal axis being disposed beneath said foot support portion, said at least one foot-pedal tracing a substantially elliptical foot-path as said epicyclic gear train operates, and said elliptical foot-path having a major axis and a minor axis.

29. The exercise apparatus of claim 28 wherein the major axis of said elliptical foot-path is about quadruple said effective crank-arm length.

30. An elliptical foot-path exercise apparatus comprising a support frame, a single-piece central crank supported relative to said support frame so as to be rotatable about a crank axis, said crank having an effective crank-arm length, a plurality of gears sized, positioned and supported relative to one another so as to form an epicyclic gear train, said plurality of gears including a right planetary gear and a left planetary gear, each of said planetary gears being rotatable about respective axes which axes intersect said crank, and a right foot pedal and a left foot pedal each being supported relative to each corresponding planetary gear such that each of said foot pedals traces a substantially elliptical path as said crank is rotated, each of said right foot pedal and said left foot pedal comprising a respective pivot axis and a respective foot supporting portion adapted to support a user's foot, a part of said respective foot support portion being disposed vertically above said respective pivot axis and said pivot axis intersecting with the respective one of said left planetary gear and said right planetary gear.

31. The exercise apparatus of claim 30, wherein each of said foot pedal pivot axes is eccentrically positioned on each corresponding planetary gear.

32. The exercise apparatus of claim 31, wherein said apparatus is adapted to allow a major axis of said elliptical path to be adjustable by varying a distance between a center point of said planetary gear and said non-central points to which said foot pedals are attached.

33. The exercise apparatus of claim 30, wherein said crank arm length is defined as a distance between said crank axis and one of said planetary gear axes.

34. The exercise apparatus of claim 30, wherein said planetary gear axes are parallel with said crank axis.

35. The exercise apparatus of claim 30, wherein said plurality of gears includes exactly one internal ring gear sized and disposed to engage with said planetary gears.

36. The exercise apparatus of claim 35, wherein said planetary gears are related to said internal ring gear by a ratio of 0.5.

37. The exercise apparatus of claim 35, wherein each of said planetary gears is related to each of said external sun gears by a ratio of 0.5.

38. The exercise apparatus of claim 37, wherein said major axis is greater than twice said effective crank-arm length.

39. The exercise apparatus of claim 30, wherein said plurality of gears includes a right external sun gear and a left external sun gear, said sun gears being sized and disposed to engage with said planetary gears.

40. An exercise apparatus comprising a support frame having a right side and a left side, at least one crank supported relative to said support frame so as to be rotatable about a crank axis, at least one sun/ring gear supported on said support frame, at least one planetary gear pivotally supported relative to a said at least one crank, rotatable therewith and sized and positioned to engage said at least one sun/ring gear so as to form an epicyclic gear train, and at least one foot pedal pivotally supported relative to said at least one planetary gear, said at least one foot pedal being disposed between said right side and said left side of said support frame.

41. The exercise apparatus of claim 40 comprising a right crank and a left crank, each said crank being supported relative to said support frame so as to be rotatable about a common crank axis, a right sun/ring gear and a left sun/ring gear, each of said sun/ring gears being supported on a corresponding side of said support frame such that a space is provided therebetween, and a right planetary gear and a left planetary gear, each planetary gear being pivotally supported relative to a corresponding one of said cranks, rotatable therewith and sized and positioned to engage a corresponding one of said sun/ring gears so as to form an epicyclic gear train.

42. The exercise apparatus of claim 41 further comprising a right foot-pedal and a left foot-pedal, each foot pedal being pivotally supported relative to a corresponding one of said planetary gears, said right and left foot pedals being disposed between said right and left sides of said support frame.

43. The exercise apparatus of claim 41, wherein said right crank and said left crank are in mechanical communication such that the rotation of the right crank is coupled with the rotation of the left crank.

44. The exercise apparatus of claim 43 further comprising a resistance device and/or motor coupled to said cranks.

45. An exercise device comprising a support frame, a crank supported by said support frame, said crank being rotatable about a crank axis, a planetary gear rotatably supported by said crank, said planetary gear being rotatable about a planetary axis, a pedal rotatably supported by said planetary gear, said pedal being rotatable about a pedal axis, said pedal axis extending through said planetary gear, said planetary gear engaging a sun/ring gear, said sun/ring gear having an effective working diameter, said pedal following a substantially elliptical foot-path when said crank rotates about said crank axis, said substantially elliptical foot path having a major diameter that is less than said effective working diameter of said sun/ring gear.

46. The exercise device of claim 45, wherein said crank axis does not intersect said planetary gear.

47. The exercise device of claim 45 further comprising a second pedal and said crank being disposed between said pedal and said second pedal.

48. The exercise device of claim 45, wherein said planetary gear has an effective working diameter and said planetary gear effective working diameter is about one-half said sun/ring gear effective working diameter.

49. The exercise device of claim 48, wherein said sun/ring gear effective working diameter greater than about 16 inches.

50. The exercise device of claim 45, wherein a distance between said crank axis and said planetary axis is greater than about 4 inches.

51. The exercise device of claim 45 further comprising means for limiting procession of said elliptical foot-path.

52. An exercise device comprising a support frame, a crank being supported by said support frame, said crank being rotatable about a crank axis, an intermediate member being supported by said crank, a pedal being supported by said intermediate member and being pivotable about a pedal axis, said pedal being adapted to support a foot above said pedal axis, said pedal axis revolving in a circular pattern around an axis that extends through said intermediate member and said intermediate member axis revolving around said crank axis in a circular pattern such that said pedal revolves around said crank axis in an elliptical pattern.

53. The device of claim 52, wherein said intermediate member is a planetary gear, said crank is a sun/ring gear and said planetary gear meshes with said sun/ring gear.

54. The device of claim 53, wherein said planetary gear has an effective diameter and said planetary gear has an effective diameter that is one-half of said effective diameter of said planetary gear.

55. An elliptical foot-path exercise apparatus comprising:

a support frame;

at least one crank being supported relative to said support frame so as to be rotatable about a crank axis, said at least one crank having an effective crank-arm length;

at least one foot pedal being mechanically coupled to said at least one crank through at least one planetary gear such that said at least one foot pedal is attached to said at least one planetary gear and said at least one planetary gear is attached to said at least one crank, said at least one foot pedal being sized and arranged relative to said at least one crank so as to follow a substantially elliptical foot-path comprising a major axis, a length of said major axis of said elliptical foot-path being adjustable by varying a point-of-attachment of said at least one foot pedal along said at least one planetary gear, said at least one planetary gear being sized and arranged to engage at least one sun/ring gear so as to form an epicyclic gear train, and each of said gears having an effective working diameter.

56. The exercise apparatus of claim 55, wherein said effective working diameter of said at least one planetary gear is equal to one-half said effective working diameter of said at least one sun/ring gear.

57. The exercise apparatus of claim 55 further comprising a resistance device and/or motor coupled to said at least one crank.

58. An exercise device comprising a support frame, a crank supported by said support frame, said crank being rotatable about a crank axis, a planetary gear rotatably supported by said crank, said planetary gear being rotatable about a planetary axis, a pedal rotatably supported by said planetary gear, said pedal being rotatable about a pedal axis, said pedal axis extending through said planetary gear, said planetary gear engaging a sun/ring gear, said pedal following a substantially elliptical foot-path when said crank rotates about said crank axis, said planetary gear having an effective working diameter, said sun/ring gear having an effective working diameter and said planetary gear effective working diameter being about one-half said sun/ring gear effective working diameter.

59. The exercise device of claim 58, wherein said sun/ring gear effective working diameter greater than about 16 inches.

60. The exercise device of claim 58 further comprising a second pedal and said crank being disposed between said pedal and said second pedal.

61. The exercise device of claim 58, wherein said crank axis does not intersect said planetary gear.

62. The exercise device of claim 58, wherein a distance between said crank axis and said planetary axis is greater than about 4 inches.

63. The exercise device of claim 58 further comprising means for limiting procession of said elliptical foot-path.

* * * * *